US012311985B1

(12) United States Patent
Given, II

(10) Patent No.: US 12,311,985 B1
(45) Date of Patent: May 27, 2025

(54) TANK CAR RECOVERY SYSTEM AND METHOD OF USE

(71) Applicant: John Franklin Given, II, Denton, TX (US)

(72) Inventor: John Franklin Given, II, Denton, TX (US)

(73) Assignee: Hulcher Services Inc., Denton, TX (US)

( * ) Notice: Subject to any disclaimer, the term of this patent is extended or adjusted under 35 U.S.C. 154(b) by 105 days.

(21) Appl. No.: 17/687,214

(22) Filed: Mar. 4, 2022

(51) Int. Cl.
*B61K 5/02* (2006.01)

(52) U.S. Cl.
CPC ..... *B61K 5/02* (2013.01)

(58) Field of Classification Search
CPC ..... B61K 5/02
See application file for complete search history.

(56) References Cited

U.S. PATENT DOCUMENTS 1,367,976 A * 2/1921 Jacobson ..... B66C 1/16 294/74
3,602,375 A * 8/1971 Martinson ..... B60P 1/6445 212/73
4,022,331 A * 5/1977 Bean ..... A01M 7/0085 414/920
4,223,612 A * 9/1980 Polley ..... B61D 5/06 105/362
4,369,968 A * 1/1983 Price ..... A63B 21/0724 482/106
4,407,203 A * 10/1983 Harbin ..... B61K 5/02 105/362
4,557,199 A * 12/1985 Everett, Jr. ..... B61D 5/06 294/67.4
5,076,173 A * 12/1991 Baker ..... B61D 5/06 105/362
5,184,860 A * 2/1993 Bouillon ..... B66C 1/10 D34/33
5,620,298 A * 4/1997 Barwise ..... B66C 1/585 414/734
7,004,697 B2 * 2/2006 Alaweih ..... B60P 3/2245 410/151
7,785,057 B2 * 8/2010 Noonan ..... A01D 87/127 414/412
7,963,230 B2 * 6/2011 Simpson ..... B61D 5/00 414/592
10,150,651 B2 * 12/2018 Isringhausen ..... B66C 1/425
11,325,814 B2 * 5/2022 Isringhausen ..... B66C 1/44
2008/0035015 A1 * 2/2008 Simpson ..... B61D 5/00 105/360
2011/0209641 A1 * 9/2011 Simpson ..... B61D 5/00 105/358

* cited by examiner

*Primary Examiner* — Jason C Smith
(74) *Attorney, Agent, or Firm* — Richard Eldredge; Leavitt Eldredge Law Firm

(57) ABSTRACT

A tank car recovery system utilizes a lifting bar that attaches at two points to the tank car by lifting points. The lifting bar is raised by hoists attached at either side. Rigging is connected to the hoists and the lifting bar. Rigging is also used to attach the lifting bar to the tank car. The hoists are operated separately to adjust the position or rate of movement of each side of the tank car.

2 Claims, 3 Drawing Sheets

TANK CAR RECOVERY SYSTEM AND METHOD OF USE

BACKGROUND

1. Field of the Invention

The present invention relates generally to railroad systems and methods, and more specifically, to a tank car recovery system that lifts a railroad car after it derails from both sides simultaneously and places it back on the rails.

2. Description of Related Art

Railroad systems are well known in the art and are effective means to transport large amounts of cargo from one place to another along a set of rails that keep a locomotive and its cars thereon. Common railroad systems include locomotives or engines and rolling stock or cars these have wheels that roll along a set of rails. The rails create a low friction environment so that the train is able to move large amounts of material quickly. Each wheel has a flange on it that sits on the inside of the rails to keep the engine or rolling stock on the rails both in the straight or on curves.

One of the problems associated with common railroad systems is their limited use. For example, when a car leaves the rails, it is considered derailed and cannot travel or move. Cars in this condition become useless or worse block the railroad for other cars to use. Tank cars are not constructed to resist the forces applied to them when pulled by recovery vehicles and are often damaged or destroyed when they derail through the recovery efforts.

The cost of the tank cars when not in use or if it is replaced is lost while it is derailed or destroyed while recovered. This loss limits the efficiency of the tank car, the recovery process, and the operators of the railroad. Commonly, the use of the railroad, the rolling stock, and the locomotives are billed hourly and at significant cost. When a car becomes derailed it takes hours if not days to recover it, meanwhile the car at a minimum is out of service.

Accordingly, although great strides have been made in the area of railroad systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
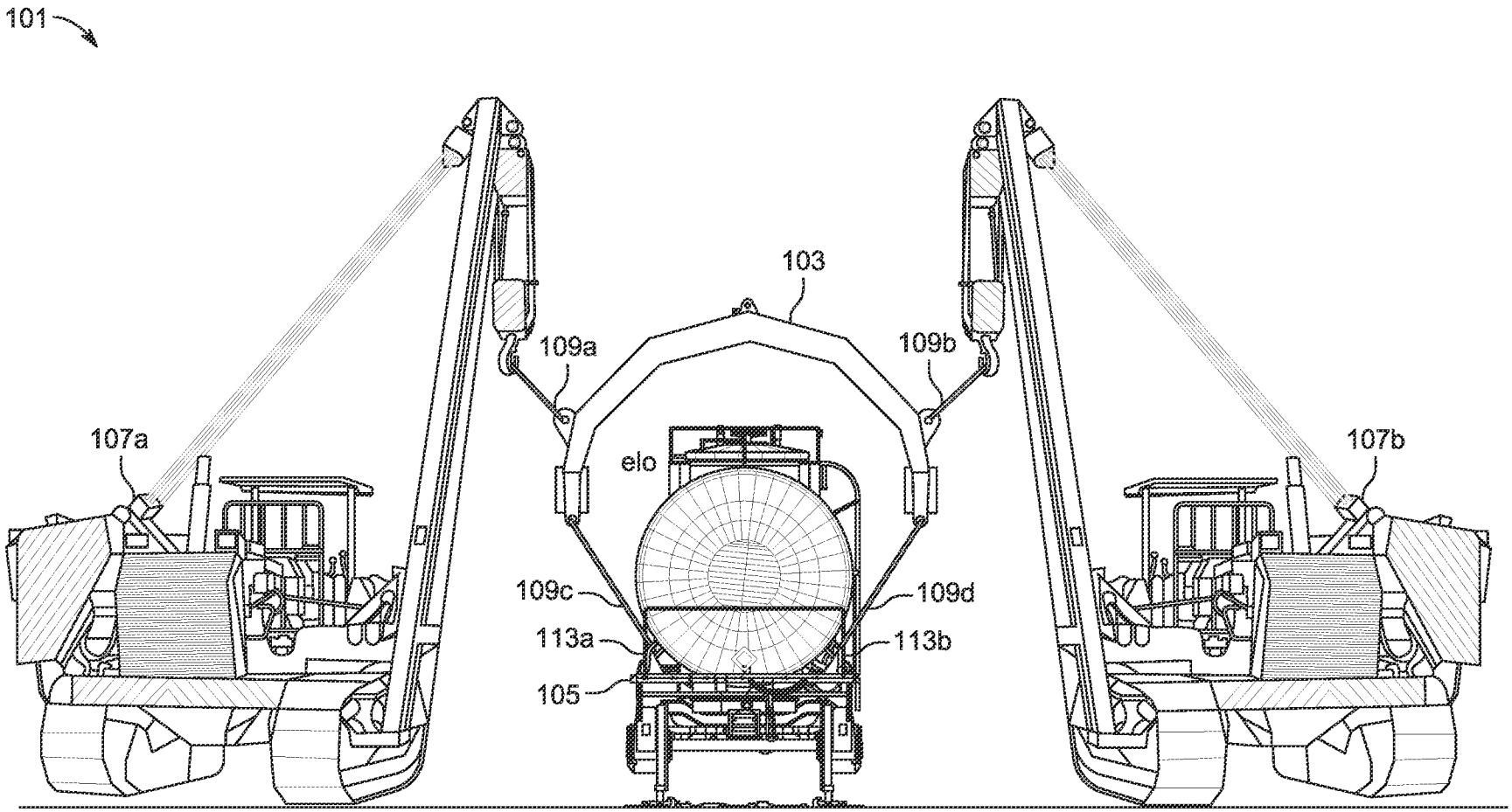
FIG. 1 is a front view of a tank car recovery system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional railroad systems. Specifically, the present invention provides for the efficient recovery of a derailed tank car that does not further damage the tank car. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a tank car recovery system in accordance with a preferred embodiment of the present application. It will be appreciated that system 101 overcomes one or more of the above-listed problems commonly associated with conventional railroad systems.

In the contemplated embodiment, system 101 includes a lifting bar 103 that is attached to a tank car 105 via rigging 109 such as cables, ropes, or the like, at lifting points 113 attached to the tank car 105. Hoists 107 are attached to the lifting bar 103 via rigging 109.

Figure 2:
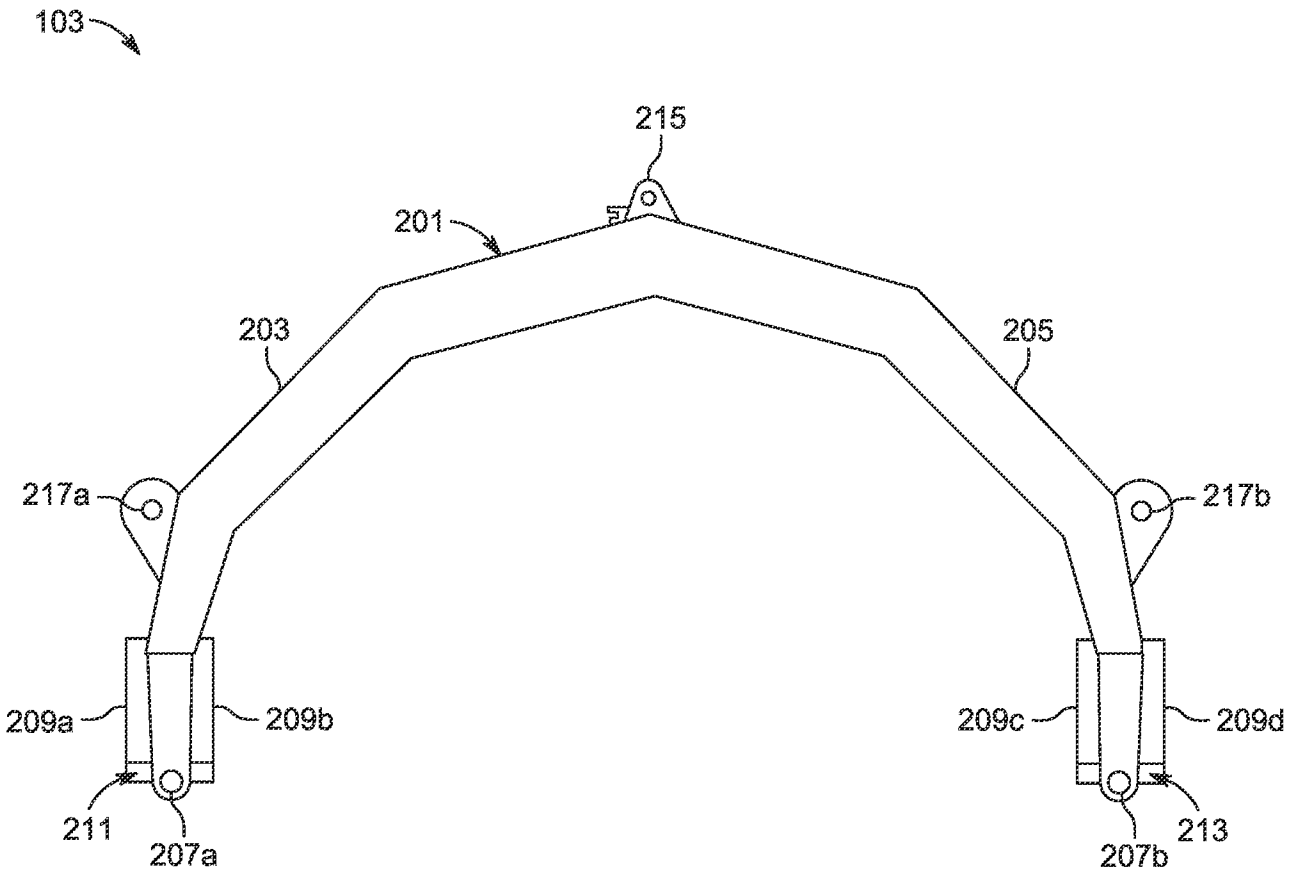
FIG. 2 is a front view of the lifting bar of the system of FIG. 1.

Referring now to FIG. 2 the lifting bar 103 is further depicted and includes a body 203 with a first arm 203 attached to a second arm 205. Each of the arms has a hoist point 217 attached thereto. The first arm 203 at a first end 211 has a rigging point 207 attached thereto and counterweights 209 attached. The second arm 205 at a second end 213 has a rigging point 207 attached thereto and counterweights 209 attached.

In use, the lifting bar 103 is positioned over the tank car 105 by the hoists 107. The lifting bar 103 is then attached to the tank car 105 via rigging 109 and lifting points 113 of the tank car 105. The hoists 107 then raise the lifting bar 103 and the tank car 105 follows so that the weight thereof is not placed on the tank. The tank car 105 is moved so that it is set on rails.

It should be appreciated that one of the unique features believed characteristic of the present application is that the lifting bar 103 attaches to multiple points on the tank car 105 to distribute the weight thereof. The lifting bar 103 further allows for the tank car 105 to be manipulated to allow it to be placed on rails.

Figure 3:
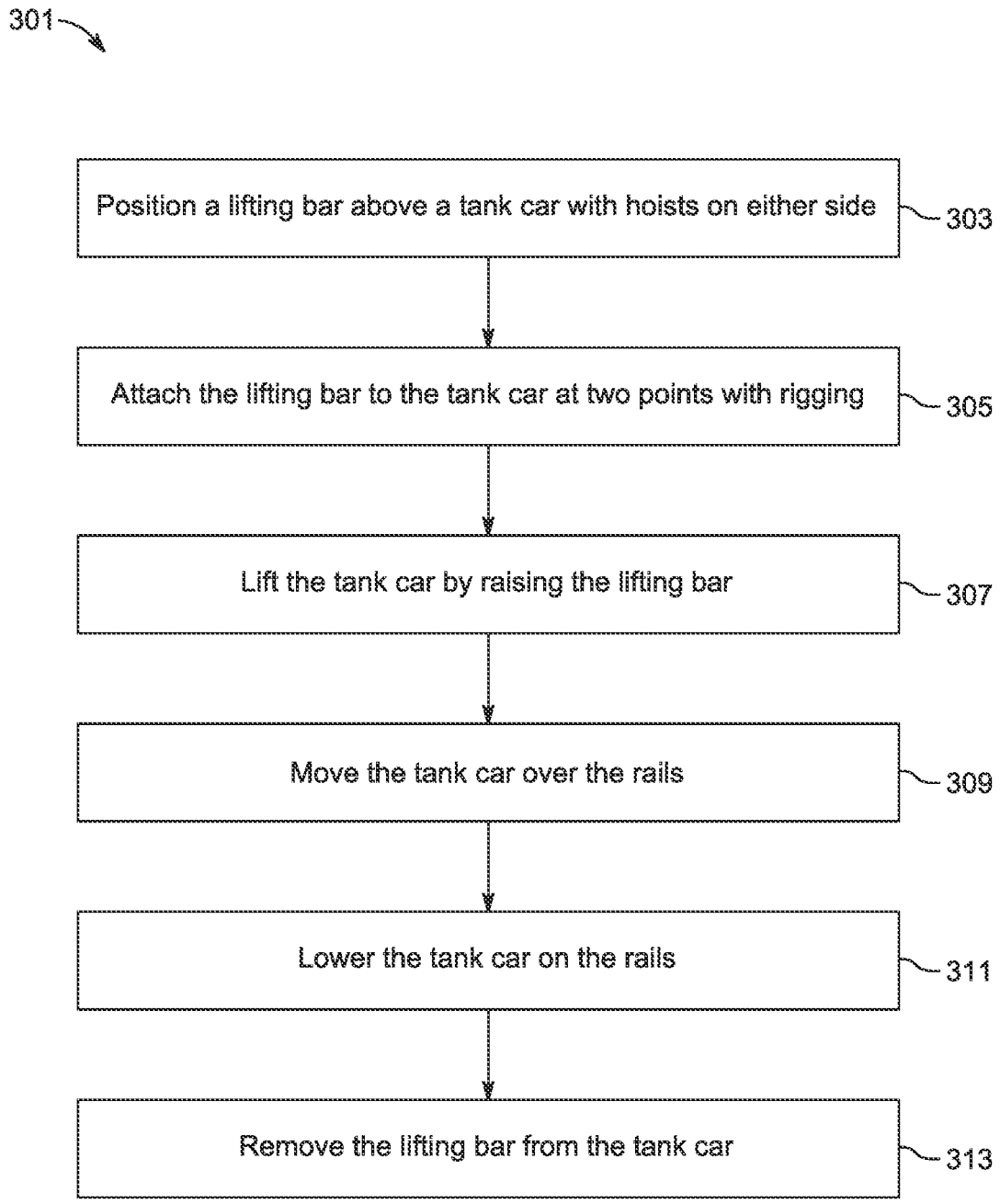
FIG. 3 is a flowchart of a method of recovering a derailed tank car.

Referring now to FIG. 3 a method of recovering a tank car is depicted. Method 301 includes positioning a lifting bar above a tank car with hoists on either side 303, attaching the lifting bar to the tank car at two points with rigging 305, lifting the tank car by raising the lifting bar 307, moving the tank car over the rails 309, lowering the tank car on the rails 311, and removing the lifting bar from the tank car 313.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A tank car recovery system for a tank car, the tank car recovery system comprising:

a lifting bar that includes a body forming a first arm integral with a second arm, the body forming a generally C-shaped configuration;

the first arm having:

(i) a first hoist point configured to releasably engage with a first rigging of a first hoist, (ii) a first rigging point configured to engage with a second rigging that attaches to the tank car, and (iii) a first counterweight attached thereto;

the second arm having:

(i) a second hoist point configured to releasably engage with a third rigging of a second hoist, (ii) a second rigging point configured to engage with the second rigging that attaches to the tank car, and (iii) a second counterweight attached thereto;

wherein the first hoist point and the second hoist point are collectively referred to as "the lifting points," and wherein the first hoist and the second hoist each attach to the lifting bar via the respective first rigging and third rigging at the lifting points, and the lifting bar attaches to the tank car via the second rigging at the first rigging point and the second rigging point, thereby raising the tank car via the lifting bar.

2. A method of recovering a tank car, comprising:

providing the tank car recovery system of claim 1;

positioning the lifting bar above the tank car with the first hoist and the second hoist on either side of the tank car;

attaching the lifting bar to the tank car with the second rigging;

lifting the tank car by raising the lifting bar via the first hoist and the second hoist;

moving the tank car over the rails;

lowering the tank car on the rails; and removing the lifting bar from the tank car.

* * * * *